US011885590B1

(12) United States Patent
Price

(10) Patent No.: US 11,885,590 B1
(45) Date of Patent: Jan. 30, 2024

(54) ADJUSTABLE CLIP SYSTEM FOR HOLSTERS AND HOLSTER RIGS

(71) Applicant: Richard J. Price, Fort Myers, FL (US)

(72) Inventor: Richard J. Price, Fort Myers, FL (US)

( * ) Notice: Subject to any disclaimer, the term of this patent is extended or adjusted under 35 U.S.C. 154(b) by 0 days.

(21) Appl. No.: 17/856,319

(22) Filed: Jul. 1, 2022

(51) Int. Cl.
*F41C 33/04* (2006.01)

(52) U.S. Cl.
CPC ..... *F41C 33/041* (2013.01); *F41C 33/048* (2013.01)

(58) Field of Classification Search
CPC .. F41C 33/041; F41C 33/0236; F41C 33/048; F41C 33/043; A45F 5/02; A45F 5/021
See application file for complete search history.

(56) References Cited

U.S. PATENT DOCUMENTS

| | | | | |
|---|---|---|---|---|
| 5,112,178 | A * | 5/1992 | Overhues | F16B 39/24 267/161 |
| 5,551,611 | A | 9/1996 | Gilmore | |
| 7,314,152 | B1 | 1/2008 | Garrett | |
| 8,789,306 | B1 * | 7/2014 | Mazzoni | F41C 33/04 42/71.01 |
| D710,595 | S | 8/2014 | Clifton, Jr. | |
| 10,209,032 | B1 * | 2/2019 | Aguirre | F41C 33/0236 |
| 10,746,502 | B1 | 8/2020 | Byone et al. | |
| 10,883,795 | B2 | 1/2021 | Rogers et al. | |
| 11,143,487 | B1 | 10/2021 | Reich et al. | |
| 11,248,875 | B2 | 2/2022 | Evans | |
| 11,268,786 | B2 | 3/2022 | Moultrie | |
| 2009/0001117 | A1 * | 1/2009 | Rassias | F41G 11/001 224/192 |
| 2016/0370144 | A1 * | 12/2016 | Laemmlen | H04B 1/3888 |
| 2018/0010885 | A1 * | 1/2018 | Tedder | F41C 33/0209 |
| 2022/0011073 | A1 * | 1/2022 | Clawson | F41C 33/041 |
| 2022/0089239 | A1 * | 3/2022 | Schepers | B62J 9/27 |

OTHER PUBLICATIONS

Tier 1 Concealed Clip https://www.tier1concealed.com/products/1-5-inch-discreet-carry-concepts?variant=32817954062407 Dated: Jul. 1, 2022.

Ulti Clip https://www.ulticlip.com/?v=7516fd43adaa Dated: Jul. 1, 2022.

HLR Discreet Gear Clips https://discreetcarryconcepts.com/HLR-Discreet-Gear-Clips%E2%84%A2-c26960683 Dated: Jul. 1, 2022.

Enigma By Phlster https://www.phlsterholsters.com/enigma-landing/ Dated: Jul. 1, 2022.

* cited by examiner

*Primary Examiner* — Corey N Skurdal

(57) ABSTRACT

An adjustable clip system (1) primarily for use with holsters (3) and holster rigs (2) that attach to a user's belt (17) or waistband (18) or pocket via one or more clips (12). The adjustable clip system allows a user to independently adjust the height of the holster or holster rig without requiring the user to raise or lower the user's belt, waistband, pocket, and/or other clothing to do so.

6 Claims, 6 Drawing Sheets

ADJUSTABLE CLIP SYSTEM FOR HOLSTERS AND HOLSTER RIGS

FIELD OF THE INVENTION

This invention generally relates to holsters used for carrying objects, such as handguns, knives, and tools, and more specifically, the present invention relates to an adjustable clip system that allows the height and position of a holster or holster rig to be independently adjusted in relation to a wearer's waistband, belt, or pocket.

BACKGROUND OF THE INVENTION

A holster is a device that is most commonly used to hold or restrict the undesired movement of a handgun in a location where the handgun may be accessible for use. Holsters are often attached to a belt or waistband and generally designed to offer protection to the handgun, secure its retention, and provide ready access to it.

The need for ready access to a handgun is often at odds with keeping the handgun concealed while also maintaining the comfort of the wearer. For example, many individuals use inside the waistband (IWB) holsters, which clip or mount to a belt. A variant design of the IWB is an "appendix inside the waistband holster" (AIWB), intended to allow a holster to be worn inside the front of the pants as opposed to the side or rear of the pants. Appendix rigs are a variant design of AIWB holsters and have an attached magazine holder and/or other attached accessories. Many conventional appendix and other styles of holsters are modular in design, thereby allowing a rig to be customized by the intended user.

Many conventional holsters, such as appendix carry holsters, share the same drawbacks. For example, it is necessary to adjust and reposition holsters, such as appendix holsters or appendix rigs, side holsters, pocket holsters, and so forth prior to sitting down. This is necessary to maintain safe access to the handgun and/or other items being carried. If the holster or rig are not pulled upward and/or repositioned prior to sitting, then the holster and handgun are forced into an angled position on the wearer's body, thereby limiting ready access to a handgun and/or other items being carried.

For example, to avoid this with an appendix carry holster, a wearer must pull or adjust the wearer's waistband and belt simultaneously with the attached holster and handgun upward over the wearer's navel so the handgun is positioned superiorly on the abdomen while sitting, bending, or squatting. This can be a difficult and uncomfortable task to accomplish.

Therefore, a need exists for an adjustable clip system that allows the height and position of a holster and/or holster rig to be independently adjusted in relation to a wearer's waistband, belt, pocket, or other attachment point.

SUMMARY OF THE INVENTION

The primary object of the present invention is to provide an adjustable clip system that allows the height of a holster or holster rig to be independently adjusted in relation to a wearer's waistband, belt, pocket, or other attachment point.

The present invention achieves the above and other objects by providing an adjustable clip system primarily for use with holsters or holster rigs wherein the adjustable clip system provides channeled plates that attach to a holster and/or holster rig in respective fixed positions. Belt clips are slidably attached to the channeled plates using at least one compressible spacer, such as a spring, a rubber non-slip washer, or equivalent, and at least one stud that engages a vertical channel. The at least one compressible spacer remains in an expanded state when resting, thereby locking the channeled plates and respective clips together.

Non-slip or textured surfaces, such as interlocking ridges, may be located on a rear surface of each channeled plate and/or the rear surface of the clip to allow the surfaces to interlock with each other when pressed together by the at least one compression spacer. Preferably, the compression spacers provide enough force and friction wherein a non-slip or textured surface is not necessary.

The device may be adjusted by applying sufficient force by means of pressing or lifting the channeled plate and/or holster/rig attached to the channeled plate in a parallel fashion in orientation to the clip to overcome the force applied by the compressive spacers. Compressive force can be applied directly to the clips to aid in minimizing the engagement of the compressive spacers with the channeled plate. Each individual channeled plates enables the mounted side to translate along the length of the respective channel. This allows the holster and/or rig to be canted and for a wearer to make dynamic intermediate adjustments for comfort. Ultimately, the wearer is allowed to adjust the height of the holster and/or holster rig while sitting or standing without being required to adjust the height of the wearer's pants or reposition clothing.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
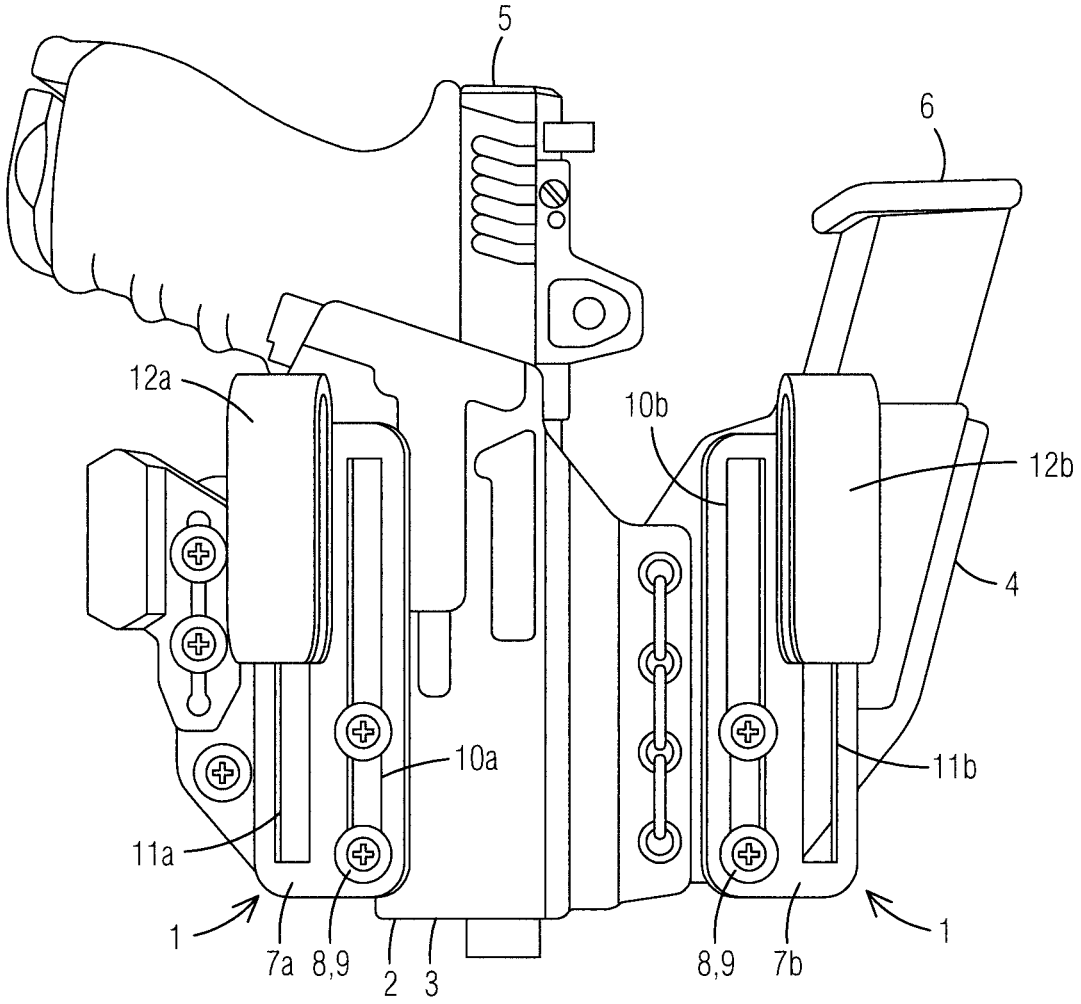
FIG. 1 is a front view of an appendix carry holster rig having an adjustable clip system of the present invention mounted thereto wherein the holster rig is in a lowered position.
Figure 2:
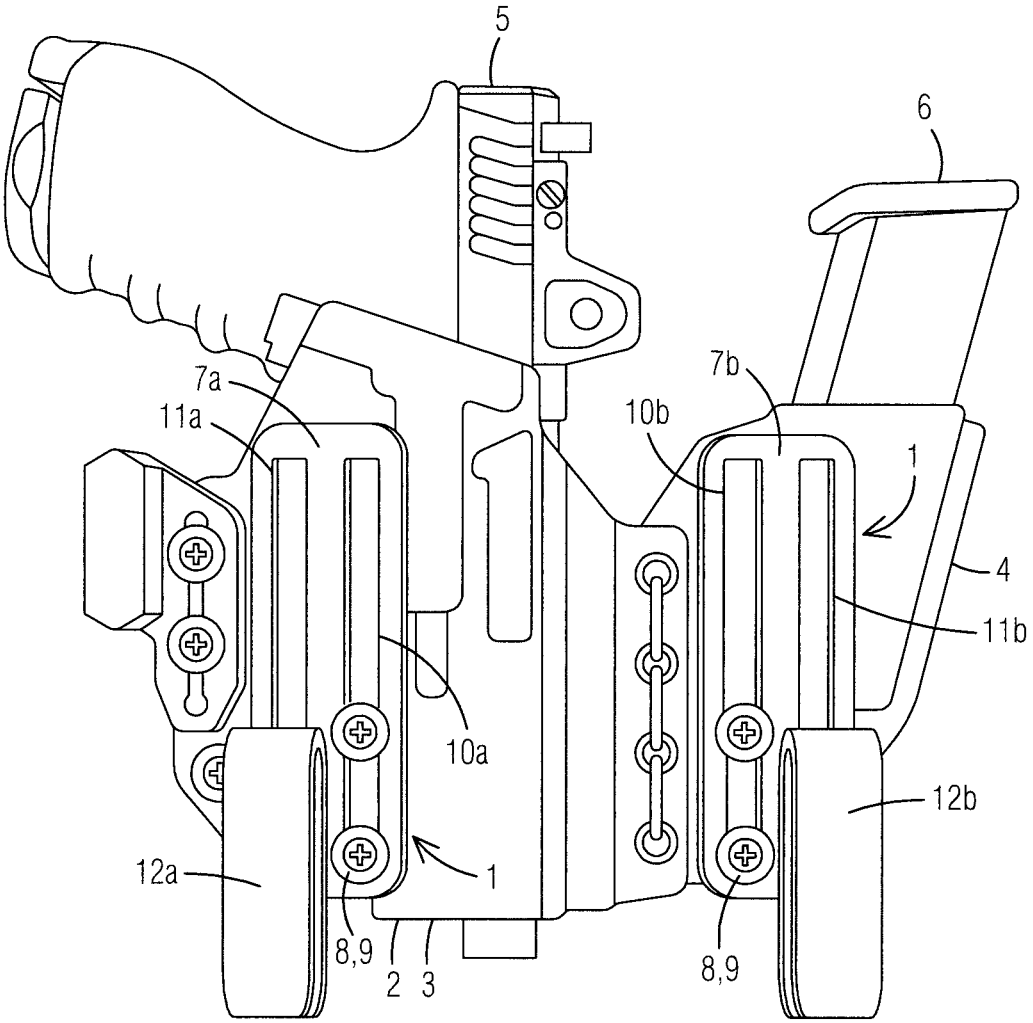
FIG. 2 is a front view of an appendix carry holster rig having an adjustable clip system of the present invention mounted thereto wherein the holster rig is in a raised position.

For purposes of describing the preferred embodiment, the terminology used in reference to the numbered accessories in the drawings is as follows:

1. adjustable clip system, generally
2. holster rig
3. holster
4. magazine holder
5. handgun
6. magazine
7*a*. first channeled plate
7*b*. second channeled plate
8. attachment means
9. screw
10. first vertical channel
10*a*. first vertical channel on first channeled plate
10*b*. first vertical channel on second channeled plate
11. second vertical channel
11*a*. second vertical channel on first channeled plate
11*b*. second vertical channel on second channeled plate
12. clip
12*a*. first clip
12*b*. second clip
13. stud
14. compressible spacer
15. spring
16. rubber washer
17. belt
18. waistband
19. stud head With general reference to FIGS. 1 and 2, front views of an appendix carry holster rig 2 having an adjustable clip system 1 of the present invention mounted thereto wherein the holster rig 2 is in a lowered position in FIG. 1 and in a raised position in FIG. 2 are illustrated. The appendix carry holster rig 2 comprises a holster 3 used for holding a handgun 5 attached to a magazine holder 4 used for carrying an extra magazine 6. As illustrated here, the adjustable clip system 1 comprises a first channeled plate 7*a* and a second channeled plate 7*b* that are attached to the holster 3 and magazine holder 4, respectively, at desired heights using an attachment means 8, such as screws 9, that are placed through a first vertical channel 10*a* located on the first channeled plate 7*a* and a first vertical channel 10*b* located on the second channeled plate 7*b*.

A second vertical channel 11*a* and a second vertical channel 11*b* are respectively located on the first channeled plate 7*a* and second channeled plate 7*b*. A first clip 12*a* and a second clip 12*b* are each slidably attached to the second vertical channel 11*a* and the second vertical channel 11*b*, respectively, via at least one stud 13 and at least one compressible spacer 14, such as a spring 15, rubber washer 16, or equivalent, as illustrated in FIG. 5. Each compressible spacer 14 is positioned in a manner to provide force on a channeled plate 7*a* or 7*b* and its respective clip 12*a* or 12*b* and further held in place by the at least one stud 13. The at least one compressible spacer 14 remains in an expanded state when resting, thereby preventing the clips 12*a* and 12*b* from sliding up and down in relation to their respective channeled plates 7*a* and 7*b*. A wearer may adjust the height of the holster rig 2 in relation to the clips 12*a* and 12*b* by manipulating and squeezing the at least one compressible spacer 14 which causes the channeled plates 7*a* and 7*b* to separate and disengage from the clips 12*a* and 12*b*, thereby allowing the holster rig 2 to slide up and down in relation to the clips 12*a* and 12*b* while the clips stay stationary on a waistband and/or belt, as illustrated in FIGS. 3 and 4.

Figure 3:
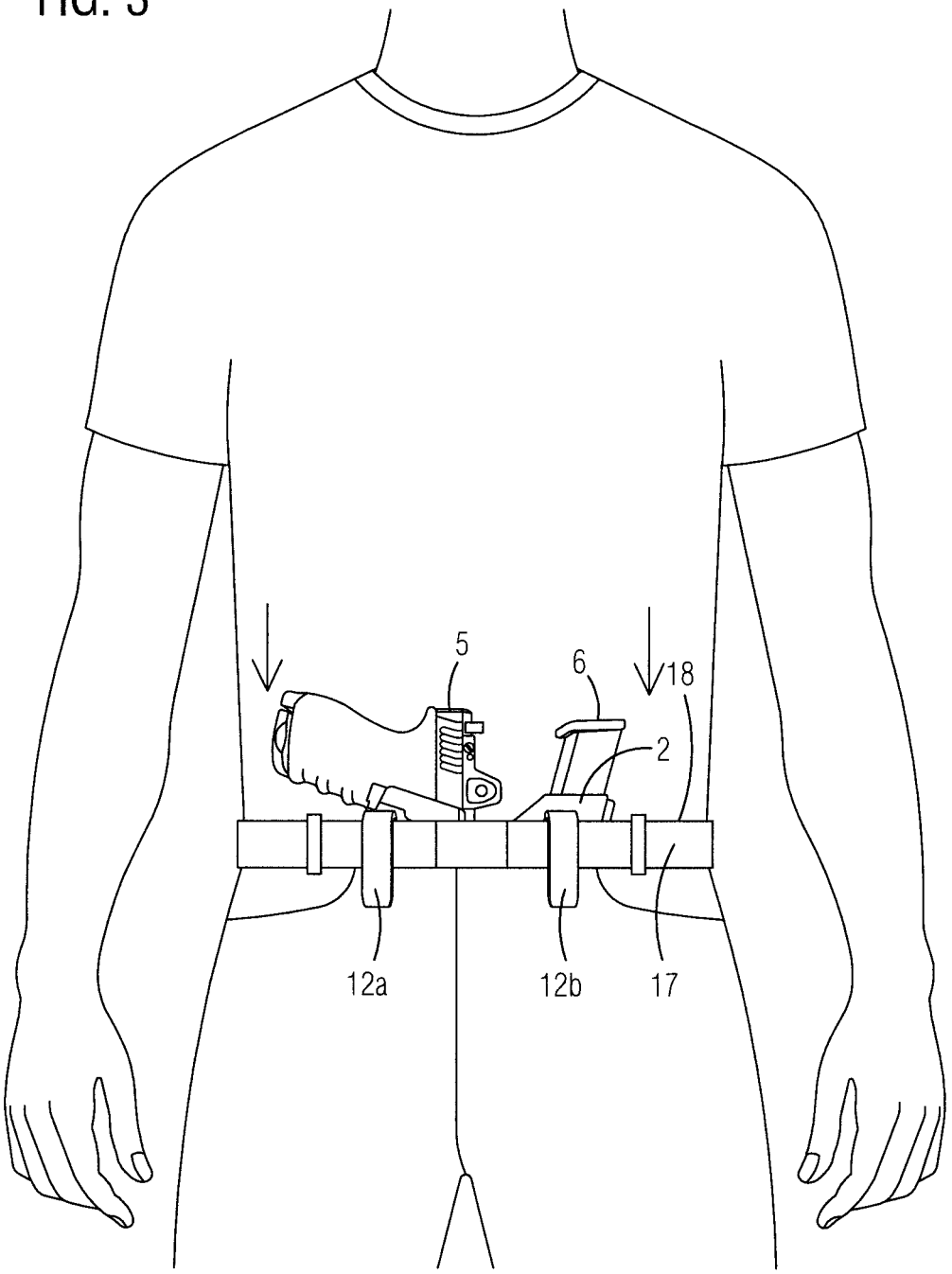
FIG. 3 is a front view of an appendix carry holster rig having an adjustable clip system of the present invention mounted thereto wherein the holster rig is in a lowered position while being worn on a wearer's waist and abdomen.
Figure 4:
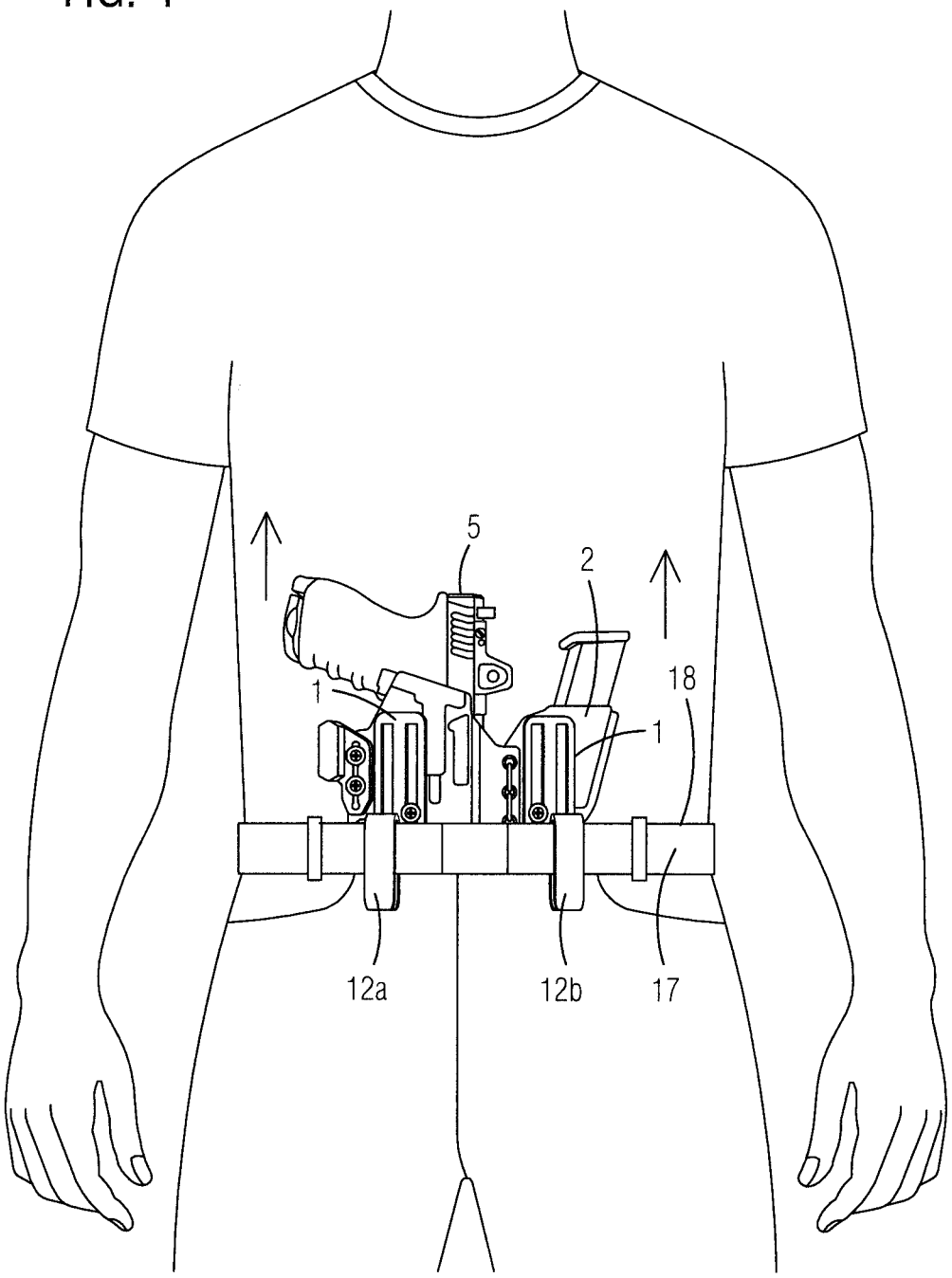
FIG. 4 is a front view of an appendix carry holster rig having an adjustable clip system of the present invention mounted thereto wherein the holster rig is in a raised position on a wearer's waist and abdomen.
Figure 5:
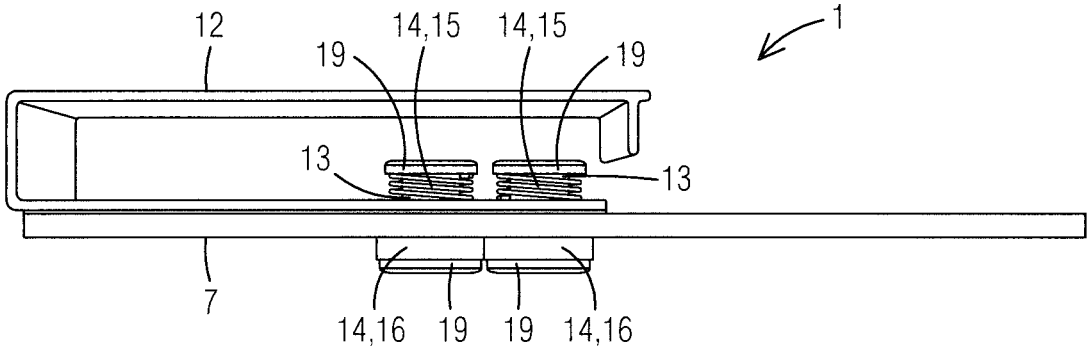
FIG. 5 is a side view of a clip and channeled plate of the adjustable clip system of the present invention.

With reference to FIGS. 3 and 4, front views of an appendix carry holster rig 2 having an adjustable clip system 1 of the present invention mounted thereto and positioned at various heights on an individual's waist and abdomen are illustrated. As illustrated in FIG. 3, an individual is carrying the appendix carry holster rig 2 in a lowered position on the individual's belt 17 and waistband 18, which is a preferable position while standing or walking. In contrast, FIG. 4 illustrates the individual carrying the appendix carry holster rig 2 in a raised position on the individual's belt 17 and waistband 18, which is preferable while sitting or bending over. A wearer may adjust the height of the holster rig 2 in relation to the clips 12*a* and 12*b* by applying sufficient force by means of pressing or lifting one or both of the channeled plates 7*a* and 7*b* and/or holster rig 2 attached to the channeled plates 7*a* and 7*b* in a parallel fashion in orientation to the clips 12*a* and 12*b* to overcome the force applied by the compressive spacers 14. Compressive force can be applied directly to the clips 12*a* and 12*b* to aid in minimizing the engagement of the compressive spacers 14 with the channeled plates 7*a* and 7*b*. Each individual channeled plate 7*a* and 7*b* enables clips 12*a* and 12*b* to translate along the length of the respective channels 10, 11.

Figure 6:
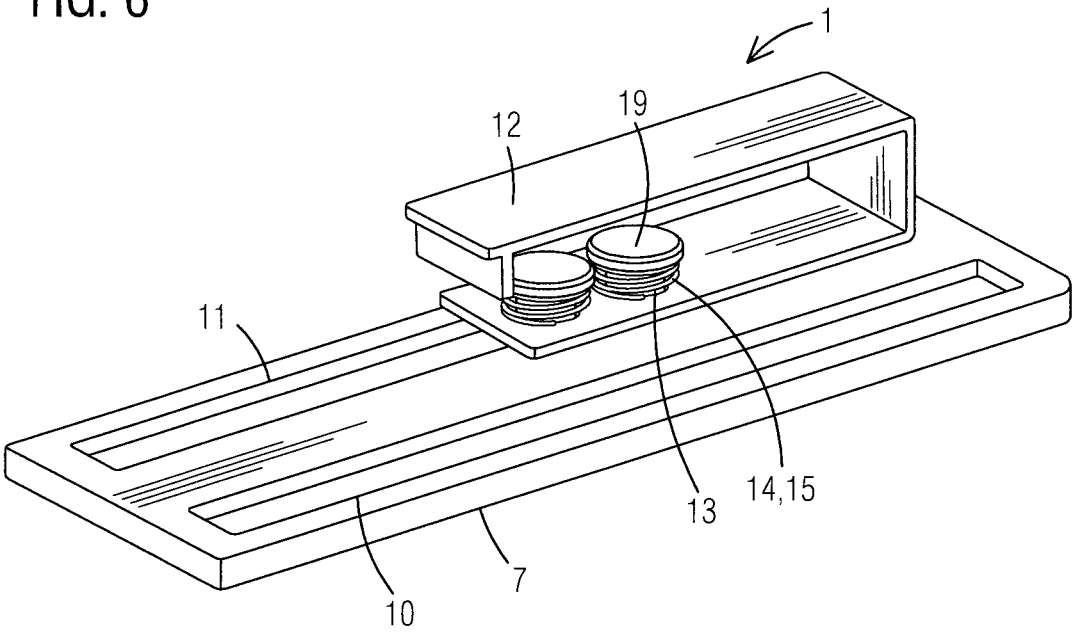
FIG. 6 is a top perspective view of a clip and channeled plate of the adjustable clip system of the present invention.
Figure 7:
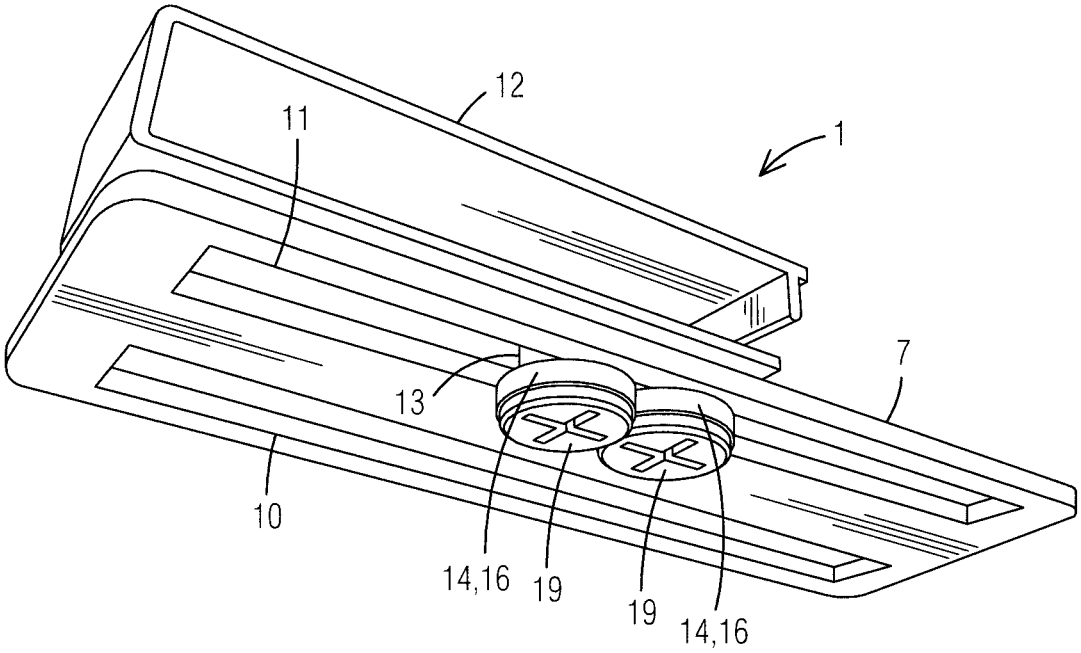
FIG. 7 is a bottom perspective view of a clip and channeled plate of the adjustable clip system of the present invention.

With reference to FIGS. 5-7, side, front perspective, and rear perspective views, respectively, of a clip 12 and channeled plate 7 of the adjustable clip system 1 of the present invention are illustrated. The channeled plate 7 may be substantially rectangular-shaped or have any other suitable geometric shape, such as a polygon or hexagon, wherein the channeled plate 7 has a first vertical channel 10 and a second vertical channel 11 oriented parallel to each other. The clip 12 is preferably substantially U-shaped and slidably attached to the second vertical channel 11 via at least one stud 13 having heads 19 on each end that retains the at least one compressible spacer 14, (such as a spring 15, rubber washer 16, or equivalent), channeled plate 7 and clip 12 together.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An adjustable clip system for holsters that allows a position of a holster to be independently adjusted in relation to a fixed attachment point on a wearer, said adjustable clip system comprising:

at least one channeled plate having a first channel and a second channel parallel with the first channel;

said first channel being attachable to a holster;

at least one substantially U-shaped clip slidably attached to said second channel to allow the at least one channeled plate to slide along a length of the second channel while the at least one clip remains stationary;

at least one stud for securing the at least one substantially U-shaped clip slidingly against the channeled plate; and at least one compressible spacer engaged with the at least one stud, the at least one compressible spacer disposed adjacent the channeled plate with sufficient friction to allow the holster and channeled plate to be moved along the length of the second channel; and wherein the at least one compressible spacer allows the wearer to make dynamic adjustments of the position of the holster in relation to the clips by applying a compressive force to the holster or channeled bracket.

2. The adjustable clip system of claim 1 wherein: said at least one compressible spacer is a spring.

3. The adjustable clip system of claim 1 wherein:

said at least one compressible spacer is a rubber washer.

4. An adjustable clip system for a holster rig that allows a position of the holster rig to be independently adjusted in relation to a fixed attachment point on a wearer, said adjustable clip system comprising:

at least two channeled plates, each having a first channel and a second channel located thereon;

said first channels and said second vertical channels being oriented parallel to each other on respective said at least two channeled plates;

said first vertical channels each being attachable to an existing holster or holster rig using at least one attachment means;

at least two substantially U-shaped clips each being slidably attached to said second channels to allow the at least two channeled plates to each slide along a length of the channels independently and in relation to the at least two clips while the at least two clips remain stationary;

at least two studs for securing the at least two substantially U-shaped clip slidingly against the respective channeled plate; and at least two compressible spacers engaged with the respective at least two studs, the at least two compressible spacers disposed adjacent the channeled plates with sufficient force to allow the holster rig and channeled plates to be moved along the length of the channels; and wherein the at least two compressible spacers allow the wearer to make dynamic adjustments of the position of the holster rig in relation to the clips by applying a compressive force to the holster rig.

5. The adjustable clip system of claim 4 wherein: said at least two compressible spacers are springs.

6. The adjustable clip system of claim 4 wherein: said at least two compressible spacers are rubber washers.

* * * * *